US010181286B2

(12) United States Patent
Kang

(10) Patent No.: US 10,181,286 B2
(45) Date of Patent: Jan. 15, 2019

(54) ORGANIC LIGHT EMITTING DISPLAY DEVICE

(71) Applicant: LG Display Co., Ltd., Seoul (KR)

(72) Inventor: Byoungwook Kang, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 230 days.

(21) Appl. No.: 15/245,826

(22) Filed: Aug. 24, 2016

(65) Prior Publication Data

US 2017/0061870 A1 Mar. 2, 2017

(30) Foreign Application Priority Data

Aug. 31, 2015 (KR) ..... 10-2015-0123258

(51) Int. Cl.
*G09G 5/00* (2006.01)
*G09G 3/3233* (2016.01)

(52) U.S. Cl.
CPC ... *G09G 3/3233* (2013.01); *G09G 2300/0819* (2013.01); *G09G 2300/0852* (2013.01); *G09G 2300/0861* (2013.01); *G09G 2300/0866* (2013.01); *G09G 2320/043* (2013.01); *G09G 2330/026* (2013.01); *G09G 2330/028* (2013.01)

(58) Field of Classification Search
CPC ..... G09G 3/3208; G09G 2330/028; G09G 3/3233; G09G 2300/0819; G09G 2320/043; G09G 2300/0852; G09G 2300/0861; G09G 2300/0866; G09G 2330/026
See application file for complete search history.

(56) References Cited

U.S. PATENT DOCUMENTS

2012/0293479 A1* 11/2012 Han ..... G09G 3/003 345/212

* cited by examiner

*Primary Examiner* — Jonathan Boyd
(74) *Attorney, Agent, or Firm* — Dentons US LLP

(57) ABSTRACT

A display device includes a display panel in which a data line and a scan line are disposed; a driving circuit configured to supply a data voltage to the data line, control an operation timing of a scan pulse applied to the scan line, and output a voltage output control signal to a signal transmission line; and a power module circuit configured to generate one or more of first and second driving voltages in response to the voltage output control signal received from the signal transmission line, wherein the voltage output control signal includes a preparation field and a channel selection field, wherein the power module circuit recognizes the voltage output control signal in response to the preparation field, and outputs the one or more of the first and second driving voltages to the driving circuit in response to the channel selection field.

9 Claims, 5 Drawing Sheets

ORGANIC LIGHT EMITTING DISPLAY DEVICE

This application claims the benefit of Korea Patent Application No. 10-2015-0123258 filed on Aug. 31, 2015, the entire contents of which is incorporated herein by reference for all purposes as if fully set forth herein.

BACKGROUND

Field of the Invention

The present disclosure relates to a display device and a method of driving the same.

Discussion of the Related Art

With reduced size and weight, flat panel displays (FPDs) have been extensively used in portable computers such as notebook computers or personal digital assistants (PDAs), as well as monitors of a desktop computers, or mobile terminals. Such flat panel displays include a liquid crystal display (LCD), a plasma display panel (PDP), a field emission display (FED), and an organic light emitting display device.

An organic light emitting display device, among flat panel displays, has high response speed and is advantageous in terms of luminous efficiency, brightness, and viewing angle. In general, in an organic light emitting display device, a data voltage is received through a driving transistor that is turned on by a scan signal, and the received data voltage is charged in a storage capacitor. Also, the data voltage charged in the storage capacitor is output to an organic light emitting diode (OLED) by using an emission control signal to thereby emit light.

The demand for high-resolution display devices is increasing. As display devices are implemented with a high resolution, designing driving circuits for driving display devices may become complicated, and such driving circuits may become more susceptible to noise.

SUMMARY

Accordingly, the present invention is directed to a display device and a method of driving the same that substantially obviate one or more problems due to limitations and disadvantages of the related art.

An advantage of the present invention is to provide a display device with improved circuit design.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the invention, as embodied and broadly described herein, a display device may, for example, include a display panel in which a data line and a scan line are disposed; a driving circuit configured to supply a data voltage to the data line, control an operation timing of a scan pulse applied to the scan line, and output a voltage output control signal to a signal transmission line; and a power module circuit configured to generate one or more of first and second driving voltages in response to the voltage output control signal received from the signal transmission line, wherein the voltage output control signal includes a preparation field and a channel selection field, wherein the power module circuit recognizes the voltage output control signal in response to the preparation field, and outputs the one or more of the first and second driving voltages to the driving circuit in response to the channel selection field.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Figure 1:
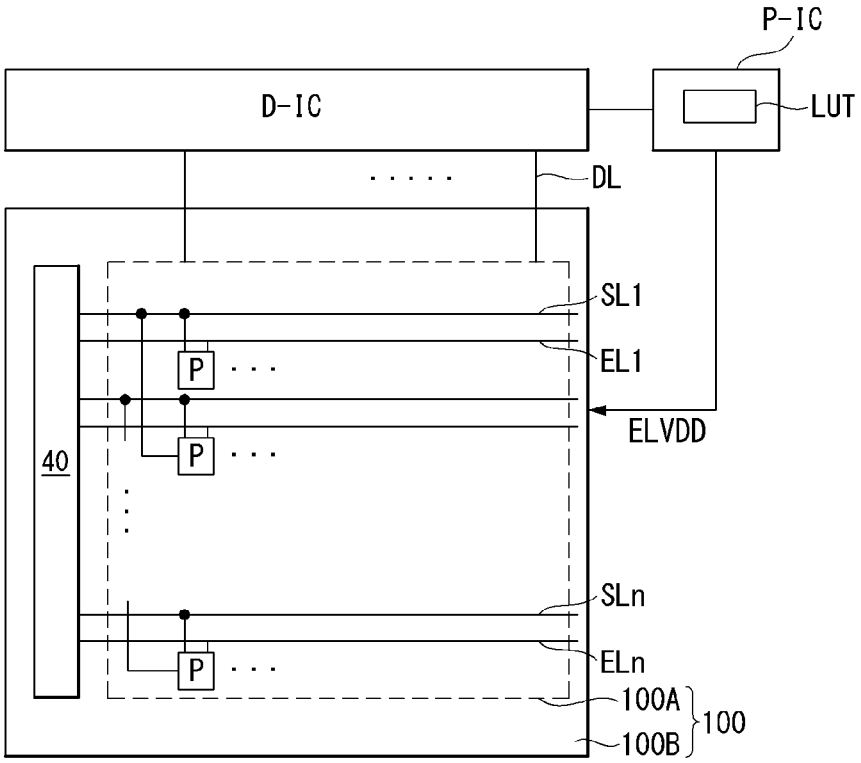
FIG. 1 is a view illustrating a configuration of a display device according to an embodiment of the present disclosure.

Hereinafter, embodiments of the present disclosure will be described in detail with reference to the accompanying drawings. Like reference numerals refer to like elements throughout. In describing the present invention, if a detailed explanation for a related known function or construction is considered to unnecessarily divert the gist of the present invention, such explanation will be omitted but would be understood by those skilled in the art.

Figure 2:
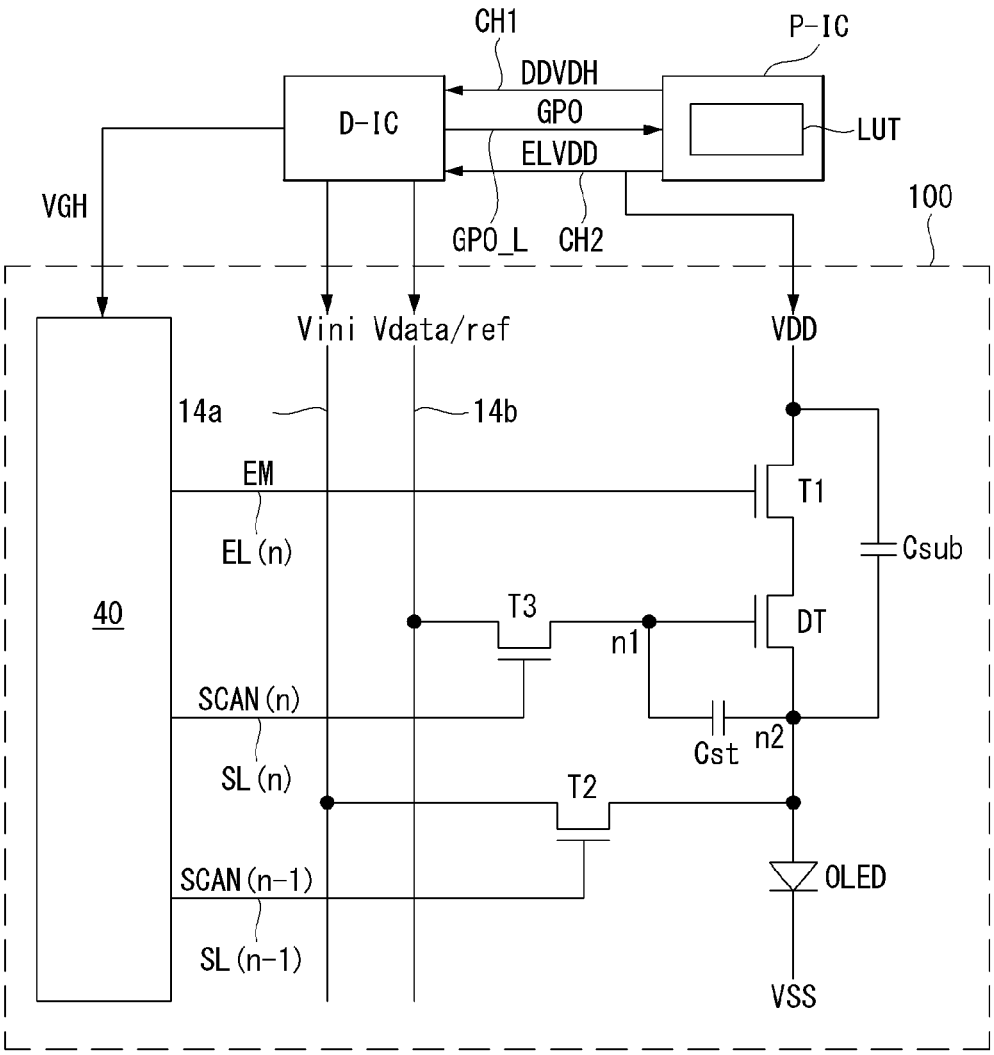
FIG. 2 is a view illustrating an example of a pixel structure illustrated in FIG. 1.

FIG. 1 is a view illustrating a display device according to an embodiment of the present disclosure. FIG. 2 is a view illustrating a pixel structure illustrated in FIG. 1.

Referring to FIGS. 1 and 2, the display device according to an embodiment of the present disclosure includes a display panel 100, a driving circuit D-IC, and a power module P-IC.

The display panel 100 includes a display region 100A in which a plurality of pixels P are disposed to display an image and a non-display region 100B, outside the display region 100A, in which various signal lines or signal pads are formed. Each pixel P is connected to a data line part DL and a gate line part SL and EL, crossing each other. The data line part DL includes an initialization line 14*a* and a data voltage supply line 14*b*, and the gate line part SL and EL includes a scan line SL and an emission line EL.

Each pixel P includes an OLED, a driving transistor DT, first to third transistors T1, T2, and T3, a storage capacitor Cst, and an auxiliary capacitor Csub. The driving transistor DT and the first to third transistors T1, T2, and T3 may be implemented as an oxide thin film transistor (TFT) including an oxide semiconductor layer.

A gate driver 40 applies a scan pulse SCAN to the scan lines SL disposed in the display region 100A and applies an emission control signal EM to an emission line EL. The gate driver 40 may be formed together with the array of pixels on a lower substrate of the display panel 100 through a gate-in-panel (GIP) process.

The driving circuit D-IC writes data of an input image into pixels. The driving circuit D-IC may include functions of a data driver and a timing controller.

The driving circuit D-IC receives image data and timing signals in synchronization with the image data from a host (not shown). The timing signals include a vertical synchronization signal Vsync, a horizontal synchronization signal Hsync, a data enable signal DE, and a main clock CLK.

The driving circuit D-IC converts the image data into positive polarity/negative polarity data voltages using positive polarity/negative polarity gamma compensation voltages and subsequently outputs the positive polarity/negative polarity data voltages to the data line part DL.

The driving circuit D-IC transmits a voltage output control signal GPO to the power module P-IC, and receives first and second driving voltages DDVDH and ELVDD generated by the power module P-IC. Timing and operation of the voltage output control signal GPO will now be described with reference to FIGS. 4 and 5.

As described above, the pixel P according to an embodiment of the present disclosure includes an organic light emitting diode (OLED), a driving transistor DT, first to third transistors T1 to T3, a storage capacitor Cst, and an auxiliary capacitor Csub.

The OLED emits an amount of light in accordance with a driving current supplied from the driving transistor DT. Multiple organic compound layers may be formed between an anode and a cathode of the OLED. The organic compound layers may include a hole injection layer (HIL), a hole transport layer (HTL), an emission layer (EML), an electron transport layer (ETL), and an electron injection layer (EIL). The anode of the OLED may be connected to a source electrode of the driving transistor DT, and the cathode electrode thereof may be connected to a ground terminal VSS.

The driving transistor DT controls an amount of driving current applied to the OLED based on a voltage between a gate electrode and a source electrode thereof. A gate electrode of the driving transistor DT is connected to a first node n1, a drain electrode thereof is connected to a source electrode of the first transistor T1, and a source electrode thereof is connected to a second node n2.

In response to the emission control signal EM, the first transistor T1 controls a current path between an input terminal of the first driving voltage ELVDD and the driving transistor DT. To this end, a gate electrode of the first transistor T1 is connected to the emission line EL, a drain electrode thereof is connected to a second channel CH2 to receive the second driving voltage ELVDD, and a source electrode thereof is connected to a drain electrode of the driving transistor DT.

In response to a scan signal SCAN[n−1] of a previous stage, the second transistor T2 provides an initialization voltage Vini provided through the initialization line 14*a* to the second node n2. To this end, a gate electrode of the second transistor T2 is connected to a scan line SL[n−1] of the previous stage, a drain electrode thereof is connected to the initialization line 14*a*, and a source electrode thereof is connected to the second node n2.

In response to a scan signal SCAN[n] of the current stage, the third transistor T3 provides a reference voltage Vref or a data voltage Vdata provided from the data voltage supply line 14*b* to the driving transistor DT. To this end, a gate electrode of the third transistor T3 is connected to a gate line SLn of the current stage, a drain electrode thereof is connected to the data voltage supply line 14*b*, and a source electrode thereof is connected to the driving transistor DT.

The storage capacitor Cst serves to maintain the data voltage Vdata provided from the data voltage supply line 14*b* during one frame period to enable the driving transistor DT to maintain a constant voltage. To this end, both electrodes of the storage capacitor Cst are connected to the gate electrode and the source electrode of the driving transistor DT, respectively. The auxiliary capacitor Csub serves to enhance efficiency of the data voltage Vdata, and both electrodes of the auxiliary capacitor Csub are connected to the second node n2 and the input terminal of the second driving voltage ELVDD.

Figure 3:
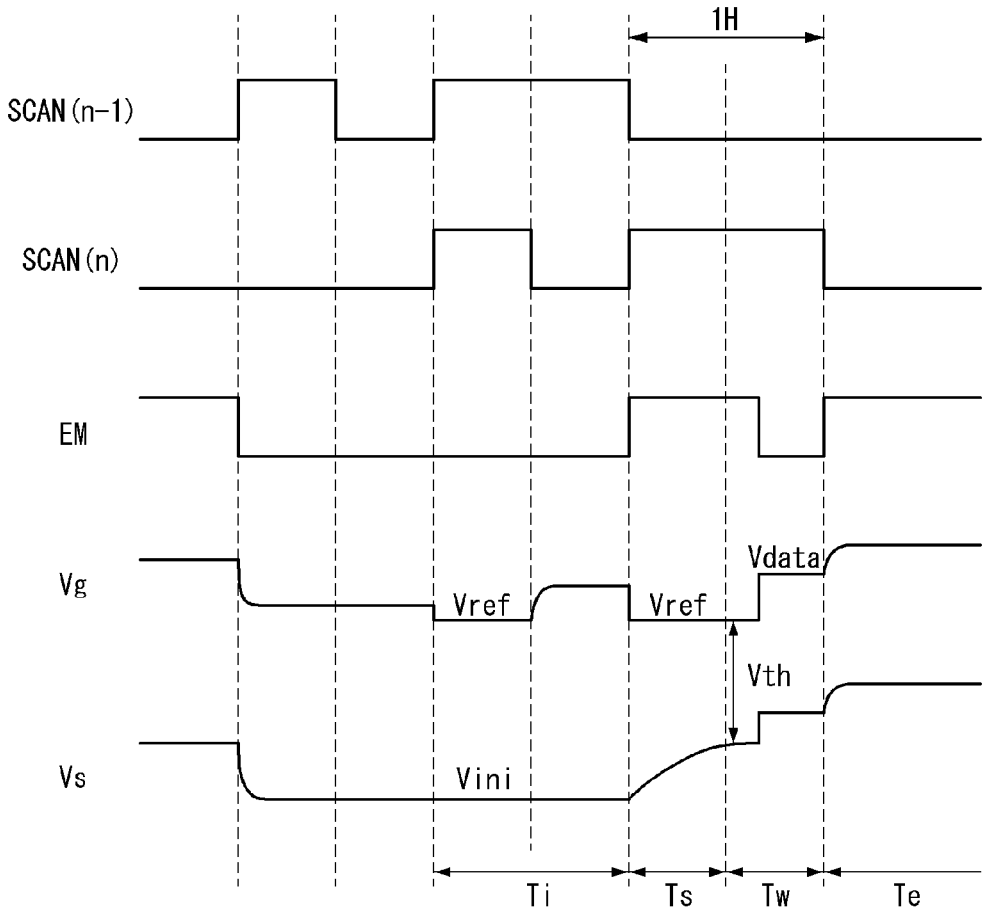
FIG. 3 is a view illustrating timing of a scan signal and an emission control signal for driving the pixel illustrated in FIG. 2.

An operation of the pixel P will be described with reference to FIG. 3. FIG. 3 is a view illustrating timing of signals applied to the pixel P of FIG. 2 and potentials of the gate electrode and the source electrode of the driving transistor DT corresponding thereto.

Referring to FIGS. 1 to 3, an operation of the pixel P according to an embodiment of the present disclosure includes an initialization period Ti in which a gate-source potential of the driving transistor DT is initialized to a specific voltage, a sampling period Ts in which a threshold voltage of the driving transistor DT is detected and stored, a writing period Tw in which the data voltage Vdata is applied, and an emission period Te in which a driving current applied to the OLED is compensated using the threshold voltage and the data voltage Vdata, independent of the threshold voltage of the driving transistor DT.

During the initialization period T1, in response to a scan signal SCAN[n−1] of the previous stage, the second transistor T2 supplies the initialization voltage Vini provided from the initialization line 14*a* to the second node n2. Also, in response to the scan signal SCAN[n] of the current stage, the third transistor T3 supplies the reference voltage Vref provided from the data voltage supply line 14*b* to the first node n1. The initialization voltage Vini supplied to the second node n2 during the initialization period T1 is to initialize the pixel P to a predetermined level. The initialization voltage Vini beneficially has a voltage value lower than that of an operating voltage of the OLED so that the OLED does not emit light. For example, the initialization voltage Vini may be set to a voltage ranging from −1 to +1 (V).

During the sampling period Ts, in response to the scan signal SCAN[n] of the current stage, the third transistor T3 supplies the reference voltage Vref provided from the data voltage line 14*b* to the first node n1. In response to the emission control signal EM, the first transistor T1 supplies the second driving voltage ELVDD to the driving transistor DT. Here, a gate electrode voltage Vg of the driving transistor maintains the reference voltage Vref. The second node n2 has a voltage increased as the current flowing to the source electrode of the driving transistor DT through the drain electrode thereof is accumulated. The voltage of the second node n2 increased during the sampling period Ts is saturated to a voltage corresponding to a difference between the reference voltage Vref and a threshold voltage Vth of the driving transistor DT. As a result, during the sampling period Ts, a potential difference between the gate and source electrodes of the driving transistor DT is substantially equal to the threshold voltage Vth.

During the writing period Tw, the first and second transistors T1 and t2 are turned off. Also, while being turned on, the third transistor T3 supplies the data voltage Vdata provided from the data voltage supply line 14*b* to the first node n1. Here, the voltage of the second node n2 in a floating state is coupled according to a ratio of the storage capacitor Cst and the auxiliary capacitor Csub so as to be increased or decreased.

During the emission period Te, the second transistor T2 is maintained in a turn-off state, the third transistor T3 is turned off, and the first transistor T1 is turned on. During the emission period Te, the data voltage Vdata stored in the storage capacitor Cst is supplied to the OLED, and thus, the OLED emits light with brightness in proportion to the data voltage Vdata. Here, an amount of current flows in the driving transistor DT in accordance with a voltage between the first node n1 and the second node n2 determined during the writing period Tw, and the amount of current passing through the source electrode of the driving transistor DT is supplied to the OLED. As a result, the OLED emits light with brightness in proportion to the data voltage Vdata.

Figure 4:
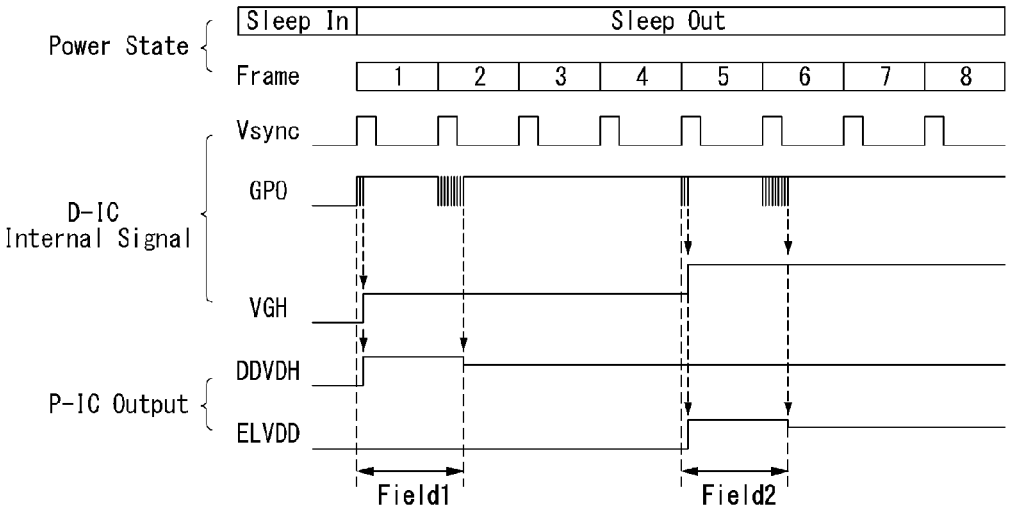
FIG. 4 is a view illustrating a voltage output control signal and an output voltage timing of a power module.
Figure 5:
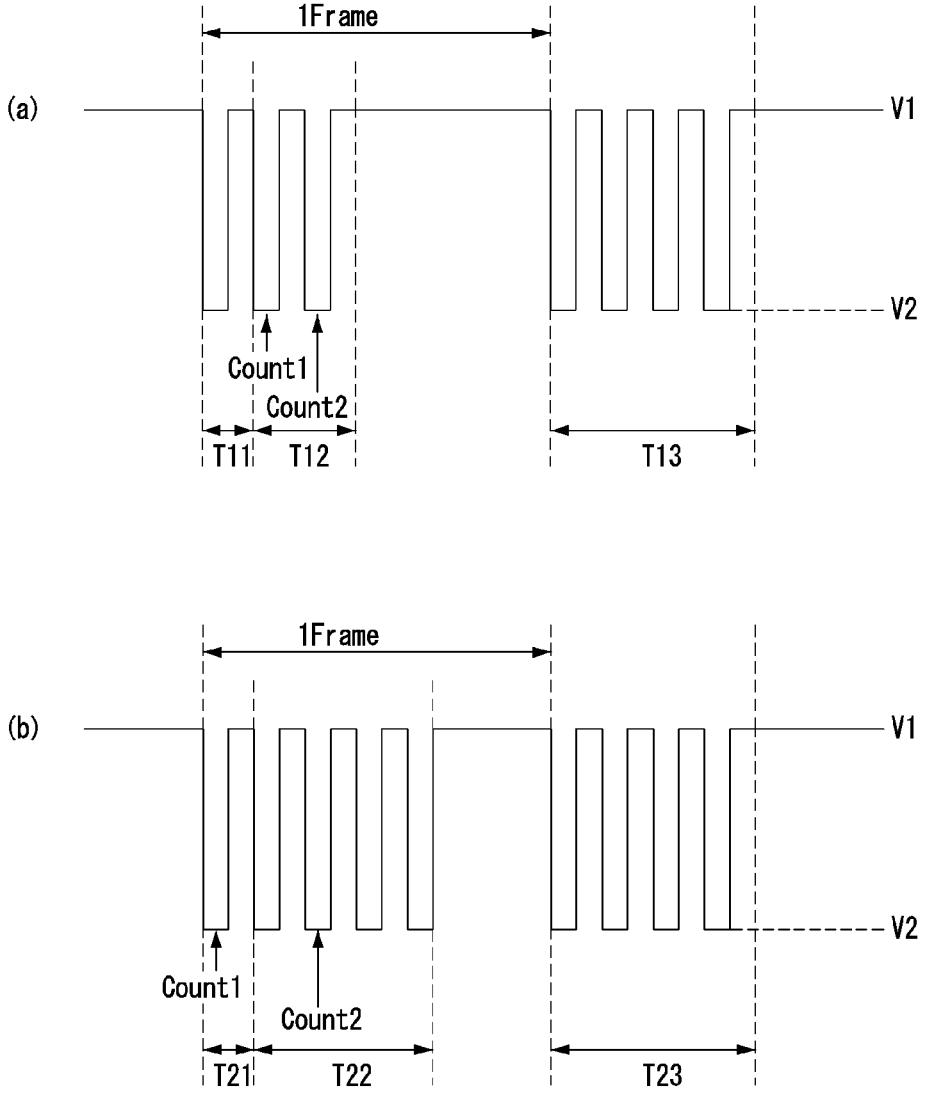
FIG. 5 is a view specifically illustrating a timing of a voltage output control signal.

FIG. 4 is a view illustrating output timings of a voltage output control signal and first and second driving voltages, and FIG. 5 is a view illustrating timing of a voltage output control signal.

A process of generating the first driving voltage DDVDH and a second driving voltage ELVDD will now be described with reference to FIGS. 2, 4, and 5.

When power is supplied to a display device in a sleep-in state to operate it in a sleep-out state, the driving circuit D-IC is provided with a vertical synchronization signal Vsync from a host (not shown). The driving circuit D-IC transmits a voltage output control signal (or a general purpose output (GPO)) to the power module P-IC at a time synchronized with the vertical synchronization signal Vsync.

The voltage output control signal GPO includes a first control field Field1 and a second control field Field2. The first control field Field1 is synchronized with a start time of a first frame, and the second control field Field2 is synchronized with a start time of a frame which has elapsed for a predetermined period of time after a termination of the first control field Field1.

As illustrated in (a) of FIG. 5, the first control field Field1 includes a first preparation field T11, a first channel selection field T12, and a voltage level setting field T13. Also, as illustrated in (b) of FIG. 5, the second control field Field2 includes a second preparation field T21, a second channel selection field T22, and a second voltage level setting field T23.

In response to the first control field Field1, the power module P-IC generates a first driving voltage DDVDH and outputs the generated first driving voltage DDVDH to a first channel CH1. In detail, the power module P-IC recognizes the voltage output control signal GPO in response to the first preparation field T11. After checking the first channel selection field T12, the power module P-IC outputs the first driving voltage DDVDH to the first channel CH1. A voltage level of the first driving voltage DDVDH at a point in time at which the first channel selection field T11 terminates is previously set or predetermined as a default value.

The driving circuit D-IC supplies the first driving voltage DDVDH supplied through the first channel CH1, and a buffer of the driving circuit D-IC outputs the data voltage Vdata using the first driving voltage DDVDH.

The first voltage level setting field T13 starts after the lapse of a predetermined period of time since the first channel selection field T12 is terminated. In detail, the first voltage level setting field T13 starts, for example, after one frame period has lapsed from a start point of the first channel selection field T12. The power module P-IC varies a voltage level of the first driving voltage DDVDH transmitted immediately after a termination of the first preparation field T11 according to the first voltage level setting field T12. Upon checking the first voltage level setting field T13, the power module P-IC varies a voltage level of the first driving voltage DDVDH at a point in time at which the first voltage level setting field T13 terminates. An embodiment in which the power module P-IC varies the voltage level will now be described.

The driving circuit D-IC generates the data voltage Vdata using the first driving voltage DDVDH of a varied voltage level transmitted after the first voltage level setting field T13.

The voltage output control signal GPO has a hold field of a predetermined frame period after the first control field Field1 terminates. After the hold field has lapsed, the second control field Field2 starts, for example, at a point in time at which a fifth frame starts.

In response to the second control field Field2, the power module P-IC generates a second driving voltage ELVDD and outputs the generated second driving voltage ELVDD through the second channel CH2. In detail, the power module P-IC checks the second preparation field T21 to recognize the voltage output control signal GPO. After checking the second channel selection field T22, the power module P-IC outputs the second driving voltage ELVDD through the second channel CH2 at a point in time at which the second channel selection field T22 terminates.

The driving circuit D-IC adds the second driving voltage ELVDD supplied through the second channel CH2 and the first driving voltage DDVDH supplied through the first channel CH1 to generate a gate high voltage VGH. The gate high voltage VGH is supplied to the gate driver 40 of the display panel 100. Also, the driving circuit D-IC supplies the second driving voltage ELVDD to the pixel array of the display panel 100.

The second voltage level setting field T22 starts, for example, after one frame period has lapsed from a time point of the second channel selection field T21. In response to the second voltage level setting field T23, the power module P-IC varies a voltage level of the second driving voltage ELVDD transmitted as a default vale. That is, after checking the second voltage level setting field T23, the power module P-IC varies a voltage level of the second driving voltage ELVDD at a point in time at which the second voltage level setting field T23 terminates.

A method for the power module P-IC to recognize the voltage output control signal GPO illustrated in FIG. 5 will now be described.

The first preparation field T11 and the second preparation field T21 of the voltage output control signal GPO include a pulse stream. Similarly, the first and second channel selection fields T12 and T22 and the first and second voltage level setting fields T13 and T23 also include a pulse stream.

The power module P-IC detects a pulse stream and counts the detected pulse stream. In a state in which a count value corresponding to an accumulation value of the pulse stream and a control command corresponding to the count value are stored in a look-up table (LUT), the power module P-IC searches for a count value corresponding to the accumulation value and performs a control command corresponding to the searched count value.

In a state in which a count value corresponding to a pulse stream is set in advance, when the power module P-IC calculates an accumulation value of the pulse stream corresponding thereto, the power module P-IC recognizes the corresponding field as the first preparation field T11. Alternatively, in a state in which a count value corresponding to a pulse stream of the second preparation field t21 is set in advance, when the power module P-IC calculates an accumulation value of a pulse stream corresponding thereto, the power module P-IC recognizes the corresponding field as the second preparation field T21. When the power module P-IC checks the first preparation field T11 or the second preparation field T21, the power module P-IC recognizes a continued pulse stream as a channel selection field.

Similarly, the power module P-IC counts a pulse stream transmitted after the preparation field, and compares an accumulation value of the counted pulse stream with a count value stored in the LUT. The power module P-IC performs a control command corresponding to the count value.

Table 1 illustrates an example of the LUT storing count values and control commands correspond thereto. In Table 1, logic represents a logic configuration of a pulse stream of a voltage output control signal capable of matching a corresponding count vale. For logic values, "0" denotes a signal of a low level voltage, and "1" denotes a signal of a high level voltage. Thus, the power module P-IC counts, for example, the number as a pulse of one time when the logic values of "0" and "1" alternate.

TABLE 1

| logic | Count value | Power module control command |
|---|---|---|
| 01 | 1 | Output first driving voltage in CH1 |
| 0101 | 2 | Output second driving voltage in CH2 |
| 010101 | 3 | Output first and second driving voltages in CH1 and CH2, respectively |
| 01010101 | 4 | Wait for setting voltage level of CH1 |
| 0101010101 | 5 | Wait for setting voltage level of CH2 |

Referring to Table 1, when an accumulation value of pulses counted in the channel selection fields T12 and T22 is 1, the power module P-IC searches for the same count value as the corresponding accumulation value, and performs a control command corresponding to the searched accumulation value. That is, when a pulse stream of logic "01" is checked, the power module P-IC outputs the first driving voltage DDVDH via the first channel CH1. Similarly, when the power module P-IC detects logic values of "0101" in the channel selection fields T12 and T22, the power module P-IC outputs the second driving voltage ELVDD via the second channel CH2. When logic values of "010101" are detected, the power module P-IC outputs the first driving voltage DDVDH via the first channel CH1 and outputs the second driving voltage ELVDD via the second channel CH2.

The channel selection fields T12 and T22 of the voltage output control signal GPO may further include a logic for preparing for setting of a voltage level. When logic values of the channel selection fields T12 and T22 are "01010101", the power module P-IC varies a voltage level of the first driving voltage DDVDH output via the first channel CH1 during the voltage level setting fields T13 and T23. Also, when logic values of the channel selection fields T12 and T12 are "0101010101", the power module P-IC varies a voltage level of the second driving voltage ELVDD output via the second channel CH2 during the voltage level setting fields T13 and T23.

Table 2 illustrates an LUT for setting the first driving voltage DDVDH during the voltage level setting field, and Table 3 illustrates an LUT for setting a second driving voltage ELVDD during the voltage level setting field.

TABLE 2

| Count value | Voltage setting value (V) |
|---|---|
| 1 | Not used |
| 2 | |
| 3 | |
| 4 | |
| 5 | |
| 6 | 3.5 |
| 7 | 3.6 |
| . . . | |
| . . . | |
| 31 | 5.9 |
| 32 | 6.0 |

Referring to Table 2, since the count values 1 to 5 correspond to logic values used in the channel selection fields T12 and T22, these count values are not used in the first voltage level setting field T13. When an accumulation value of the counted pulses is "7", the power module P-IC searches for the count value "7" from the LUT and sets a voltage level of the first driving voltage DDVDH to 3.6V. In this way, the power module P-IC varies a voltage level of the first driving voltage DDVDH according to an accumulation value of counted pulses.

TABLE 3

| Count value | Voltage setting value (V) |
|---|---|
| 1 | Not used |
| 2 | |
| 3 | |
| 4 | |
| 5 | |
| 6 | 6.5 |
| 7 | 6.6 |
| . . . | |
| . . . | |
| 31 | 8.9 |
| 32 | 9.0 |

Referring to Table 3, since count values from "1" to "5" correspond to logic values used during the channel selection fields T12 and T22, these count values are not used during the second voltage level setting field T23. As in the first voltage level setting field T13, the power module P-IC varies a voltage level of the second driving voltage ELVDD on a basis of the LUT illustrated in Table 3 during the second voltage level setting field T23.

As discussed above, the power module P-IC may control output timing and voltage levels of the first and second driving voltages DDVDH and ELVDD respectively supplied to the first channel CH1 and the second channel CH2 using a voltage output control signal GPO transmitted from a signal transmission line GPO_L.

Since the power module P-IC controls an output of a driving voltage using the signal transmission line GPO_L, the power module P-IC may be easily disposed outside the driving circuit D-IC. When the power module P-IC generates a driving voltage, a noise may be generated. Since the power module P-IC can be disposed outside the driving circuit D-IC, a noise generated in the power module P-IC may not affect the driving circuit D-IC according to an embodiment.

In particular, since the power module P-IC according to an embodiment may not require two signal transmission lines to receive a signal for controlling an output of a driving voltage provided to the first channel CH1 and the second channel CH2, the number of the signal transmission lines GPO_L may be reduced. Such a reduction in the number of signal transmission lines is advantageous in circuit design and can be advantageously applied to a portable display device due to its reduced size.

The voltage output control signal GPO illustrated in FIG. 5 represents an embodiment in which at least any one of two channels is selected and a driving voltage is output. The voltage output control signal GPO may select one or more of at least three channels to output a driving voltage. In order to select one or more of three channels, the voltage output control signal GPO may include preparation fields T11 and T12, channel selection fields T12 and T22, and voltage level setting fields T13 and T33, as illustrated in FIG. 5, and each of the fields may include a pulse stream. The power module P-IC selects one or more of three channels on a basis of an accumulation value obtained by counting pulse streams during the channel selection fields T12 and T22 and outputs a driving voltage. In order to select one or more of the three channels, the power module P-IC may use an LUT as illustrated in Table 4 below.

TABLE 4

| Logic | Count value | Power module control command |
|---|---|---|
| 01 | 1 | First driving voltage is output in CH1 |
| 0101 | 2 | Second driving voltage is output in CH2 |
| 010101 | 3 | Third driving voltage is output in CH3 |
| 01010101 | 4 | First and second driving voltages are output in CH1 and CH2, respectively |
| 0101010101 | 5 | Second and third driving voltages are output in CH2 and CH3, respectively |
| 010101010101 | 6 | First and third driving voltages are output in CH1 and CH3, respectively |
| 01010101010101 | 7 | First to third driving voltages are output in CH1 to CH3, respectively |
| 0101010101010101 | 8 | Wait for setting CH1 voltage level |
| 010101010101010101 | 9 | Wait for setting CH2 voltage level |
| 01010101010101010101 | 10 | Wait for setting CH3 voltage level |

Referring to Table 4, when an accumulation value of counted pulses is "1" to "3", the power module P-IC supplies a driving voltage to any one of first to third channels corresponding to each of the counted values. When an accumulation value of counted pulses is "4" to "6", the power module P-IC supplies a driving voltage to two channels among the first to third channels. When an accumulation value of counted pulses is "7", the power module P-IC supplies a driving voltage to the first to third channels.

When an accumulation value of counted pulses is "8", the power module P-IC varies a voltage output to the first channel during the voltage level setting field. Also, when an accumulation value of counted pulses is "9", the power module P-IC varies a voltage output supplied to the second channel, and when an accumulation value of counted pulses is "10", the power module P-IC varies a voltage output supplied to the third channel.

In this manner, since the power module P-IC according to an embodiment of the present disclosure controls a driving voltage output via three channels through a single signal transmission line, it can be advantageous in circuit design and a display device may be further reduced in size.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel in which a data line and a scan line are disposed;

a driving circuit configured to supply a data voltage to the data line, control an operation timing of a scan pulse applied to the scan line, and output a voltage output control signal to a signal transmission line; and a power module circuit configured to generate one or more of first and second driving voltages in response to the voltage output control signal received from the signal transmission line, wherein the voltage output control signal includes a preparation field and a channel selection field, wherein the power module circuit recognizes the voltage output control signal in response to the preparation field, and outputs the one or more of the first and second driving voltages to the driving circuit in response to the channel selection field, wherein the channel selection field of the voltage output control signal includes a plurality of pulses, and the power module circuit compares an accumulation value obtained by counting pulses of a pulse stream during the channel selection field with a preset count value stored in a look-up table (LUT), and outputs a driving voltage defined by the same count value as the accumulation value.

2. The display device of claim 1, wherein the voltage output control signal further includes a voltage level setting field in which a voltage level of the one or more of the first and second driving voltages is adjusted.

3. The display device of claim 2, wherein the voltage level setting field of the voltage output control signal includes a plurality of pulses, and the power module circuit compares an accumulation value obtained by counting pulses of a pulse stream during the voltage level setting field with a preset count value stored in a look-up table (LUT), and adjusts a voltage level of an output driving voltage defined by the same count value as the accumulation value.

4. The display device of claim 2, wherein the voltage output control signal further includes a field in which a constant voltage is maintained between the channel selection field and the voltage level setting field.

5. The display device of claim 1, wherein the voltage output control signal comprises:

a first control field including a first preparation field and a first channel selection field; and a second control field including a second preparation field and a second channel selection field, wherein the power module circuit outputs the first driving voltage in response to the first control field and outputs the second driving voltage in response to the second control field.

6. The display device of claim 5, wherein the first and second channel selection fields include a plurality of pulses, and the power module circuit compares an accumulation value obtained by counting pulses of a pulse stream during the first channel selection field with a first preset count value stored in a look-up table (LUT) and outputs the first driving voltage defined by the same count value as the accumulation value, and compares an accumulation value obtained by counting pulses of a pulse stream during the second channel selection field with a second preset count value stored in the LUT and outputs the second driving voltage defined by the same count value as the accumulation value.

7. The display device of claim 1, wherein the driving circuit generates the data voltage using the first driving voltage.

8. The display device of claim 1, wherein the driving circuit add the first driving voltage and the second driving voltage to generate a high level voltage of the scan pulse applied to the scan line.

9. The display device of claim 1, wherein the display panel comprises:

an organic light emitting diode (OLED); and a driving transistor configured to receive the data voltage through a gate electrode, receive the second driving voltage through a drain electrode, and have a source electrode connected to the OLED.

* * * * *